US009248937B2

(12) United States Patent
Dolos

(10) Patent No.: US 9,248,937 B2
(45) Date of Patent: Feb. 2, 2016

(54) GET YOUR MONEY'S WORTH DISPENSING CANISTER

(71) Applicant: Chasmite Dolos, Malden, MA (US)

(72) Inventor: Chasmite Dolos, Malden, MA (US)

( * ) Notice: Subject to any disclaimer, the term of this patent is extended or adjusted under 35 U.S.C. 154(b) by 31 days.

(21) Appl. No.: 14/256,934

(22) Filed: Apr. 19, 2014

(65) Prior Publication Data

US 2014/0319176 A1 Oct. 30, 2014

Related U.S. Application Data

(60) Provisional application No. 61/816,145, filed on Apr. 25, 2013.

(51) Int. Cl.

| | |
|---|---|
| ***B65D 25/08*** | (2006.01) |
| ***B65D 23/00*** | (2006.01) |
| *B65D 81/32* | (2006.01) |
| *B65D 21/02* | (2006.01) |
| *B65D 47/14* | (2006.01) |
| *B65D 47/12* | (2006.01) |

(52) U.S. Cl.

CPC ..... *B65D 23/00* (2013.01); *B65D 21/0231* (2013.01); *B65D 23/001* (2013.01); *B65D 25/08* (2013.01); *B65D 47/127* (2013.01); *B65D 47/147* (2013.01); *B65D 81/3205* (2013.01); *B65D 81/3266* (2013.01); *B65D 81/3288* (2013.01); *B65D 2231/005* (2013.01); *B65D 2231/02* (2013.01); *Y10T 29/49821* (2015.01)

(58) Field of Classification Search

CPC .. B65D 21/0234; B65D 21/0331; B65D 1/20; B65D 81/361; B65D 81/3216; B65D 81/3266; B65D 2231/005; B65D 25/08; B65D 23/00; B65D 47/122; B65D 47/127; B65D 47/147; B65D 47/0842; B65D 81/3288; B65D 81/3205; B65D 2231/02; B65D 23/001; B65D 21/0231; Y10T 29/49821

See application file for complete search history.

(56) References Cited

U.S. PATENT DOCUMENTS

| | | | | |
|---|---|---|---|---|
| 2,791,467 | A * | 5/1957 | Leshin | 222/143 |
| 3,156,369 | A * | 11/1964 | Bowes | B65D 51/285 206/222 |
| 3,998,351 | A * | 12/1976 | Smith et al. | 220/23.83 |
| 4,982,875 | A * | 1/1991 | Pozzi | B65D 81/3222 222/129 |
| 5,927,549 | A * | 7/1999 | Wood | B65D 51/285 206/222 |
| 6,003,728 | A * | 12/1999 | Elliott | B65D 47/0804 206/219 |
| 6,148,996 | A * | 11/2000 | Morini | B65D 51/285 206/222 |
| 7,377,383 | B2 * | 5/2008 | Henry | 206/222 |
| 7,870,952 | B2 * | 1/2011 | Fontana | B65D 51/2814 206/219 |
| 8,136,660 | B2 * | 3/2012 | Sharon | 206/221 |
| 8,770,399 | B2 * | 7/2014 | Hjalmarsson | B65D 51/2821 206/219 |
| 2007/0023299 | A1 * | 2/2007 | Clarkson | B65D 1/2835 206/219 |
| 2011/0272379 | A1 * | 11/2011 | Eghbaly | 215/6 |
| 2012/0217178 | A1 * | 8/2012 | Rohr | B65D 41/04 206/219 |

* cited by examiner

*Primary Examiner* — Frederick C Nicolas

(74) *Attorney, Agent, or Firm* — Jie Tan; JT Law Services, PC.

(57) ABSTRACT

A two-in-one dispensing bottle is disclosed. The bottle has a pre-cut unbroken section between its upper body portion and its lower body portion. The pre-cut unbroken section can be easily broken open with a twist and is covered with a break seal. A cover is designed to cover both the upper body portion and the lower body portion.

12 Claims, 6 Drawing Sheets

GET YOUR MONEY'S WORTH DISPENSING CANISTER

CROSS-REFERENCE

Priority is claimed from the U.S. Provisional Application No. 61/816,145 filed on Apr. 25, 2013, entirety of which is hereby incorporated by reference.

DESCRIPTION OF RELATED ART

The present application relates to a container, and more particularly to a container that is configured to allow the full use of the material at the bottom of the container.

Note that the points discussed below may reflect the hindsight gained from the disclosed inventions, and are not necessarily admitted to be prior art.

Consumer Report Studies show that skin lotion containers leave 17 to 25% of unreachable liquids at the bottom of the dispenser after its pump dispenser stops dispensing. Liquid detergent containers store 7 to 16% unreachable liquids at the bottom. Condiments container store 3 to 15% of unreachable liquids at the bottom. Toothpaste containers store 1 to 13% of unreachable liquids at the bottom, etc. Skin lotions are left more than any other type—about one fifth of their total contents, and skin lotions are expensive.

Consumers want to get their money's worth, get every last drop of what they paid for and stop wasting their hard earned money. As a result consumers practice a multitude of strenuous methods to extract those unreachable amounts left at the bottom of the containers. Consumers are willing to risk injury to get their money's worth. They have tried any or all of the following ways:

They replace the dispensing pump with regular or flip open top, then turn bottle upside down to shake or squeeze contents out. They may add some amount of distilled water if that helps. They even heat the container in either microwave or place the container in sink with dish of hot water if that helps to get the last drop of the material.

They remove the dispensing pump and dump out the remaining contents of bottle into a plastic storage bag. They cut a small corner in one of the ends of bag and squeeze contents (like in a piping bag) through opening in one end of the bag. They then need to fold up the opening and secure the bag with paper clips.

They cut container open or in half with scissors, and place the cut container in plastic bag and use it till it is empty. They use spatula, chopstick, or knife/spoon to get material out of the cut-open container.

They transfer contents to another bottle or a wide mouth tub such as a Ziploc container. However, they need to worry about contamination if dump old contents onto new contents.

They add tiny clean glass marbles to the bottom of container so that they will raise up the level of the lotion. But often the glass marbles may not be big enough which clogs the pump tube. There will still be an issue when they have to remove the marbles.

They use specialized spatula to reach inside and scoop up remains.

They remove the dispensing pump to release the remaining product from the pump, fill up sink or glass with warm water and place pump in water.

They remove pump and invert the container into funnel, and transfer the content into another vessel.

Therefore, there is a great need for a dispensing container that allows a consumer to easily access the bottom content of the container and to make use of all the content, getting all their money worth.

SUMMARY

The present application discloses new method and configuration for a dispensing container wherein the dispensing container is configured with a pre-defined unbroken pre-cut line that separates the dispensing container into a larger upper portion and a smaller lower portion for re-use. The pre-cut is covered with a break seal mechanism to prevent premature break and leakage.

In one aspect of an embodiment, the smaller lower portion of the dispensing container is of the size that is TSA (Transportation Security Administration) approved for allowing travel convenience.

In one aspect of an embodiment, the cap cover for the upper portion is designed to tightly snap onto the opened lower portion, which effective transforms the lower portion into a covered reusable bottle with a TSA approved size.

In one aspect of an embodiment, the cap cover includes a snap-on fliptop for tightly snapping onto the aperture for holding a dispensing pump, and covering the aperture after removing the dispensing pump.

In one aspect of an embodiment, a method for converting a dispensing container into a smaller size container for accessing bottom content includes breaking the dispensing container at its pre-cut line, disposing the upper portion of the container and the dispensing pump, covering the lower bottom portion with the snap-on cover that has a fliptop.

The disclosed innovation, namely Enviro Bottle Jah, in various embodiments, provide one or more of at least the following advantages. However, not all of these advantages result from every one of the innovations disclosed, and this list of advantages does not limit the various claimed inventions.

This design is environmentally friendly, it will reduce plastic waste of lotion bottles to about 25% or more. During travel, consumers can easily convert a large lotion bottle into a reusable small TSA approve container for travel, rather than having to surrender the full bottle to the TSA and having to purchase a new one just for travel. An emptied lotion bottle can also be reused as a travel size container which is perfect for flying and long road trips. Women can fill up the small container with their favorite lotion and place it in their purse and men can utilize the small container of their favorite lotion and keep it in their cars or gym bag etc.

BRIEF DESCRIPTION OF THE DRAWINGS

The disclosed application will be described with reference to the accompanying drawings, which show important sample embodiments of the invention and which are incorporated in the specification hereof by reference, wherein.

DETAILED DESCRIPTION OF SAMPLE EMBODIMENTS

Figure 1B:
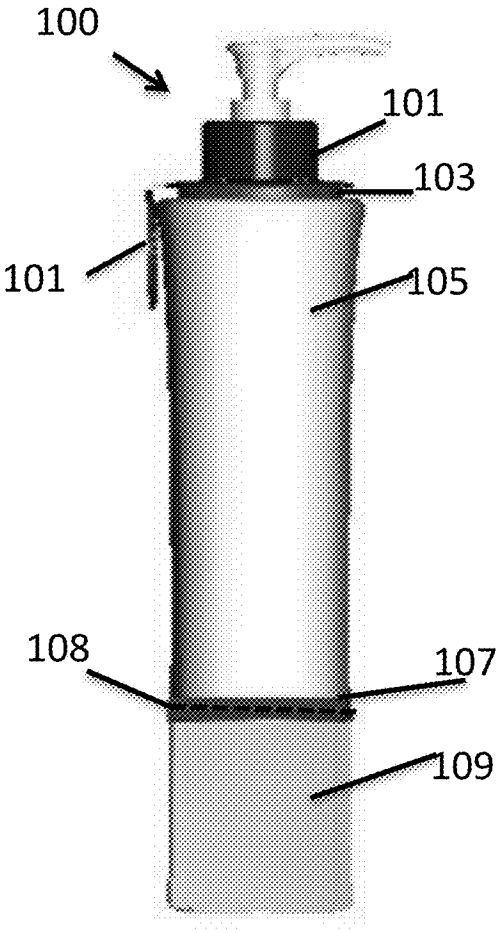
FIG. 1B is a side view of an example Get-Your-Money-Worth dispensing bottle in accordance with this application.

The numerous innovative teachings of the present application will be described with particular reference to presently preferred embodiments (by way of example, and not of limitation). The present application describes several embodiments, and none of the statements below should be taken as limiting the claims generally.

For simplicity and clarity of illustration, the drawing figures illustrate the general manner of construction, and description and details of well-known features and techniques may be omitted to avoid unnecessarily obscuring the invention. Additionally, elements in the drawing figures are not necessarily drawn to scale, some areas or elements may be expanded to help improve understanding of embodiments of the invention.

The terms "first," "second," "third," "fourth," and the like in the description and the claims, if any, may be used for distinguishing between similar elements and not necessarily for describing a particular sequential or chronological order. It is to be understood that the terms so used are interchangeable. Furthermore, the terms "comprise," "include," "have," and any variations thereof, are intended to cover non-exclusive inclusions, such that a process, method, article, apparatus, or composition that comprises a list of elements is not necessarily limited to those elements, but may include other elements not expressly listed or inherent to such process, method, article, apparatus, or composition.

It is contemplated and intended that the design apply to many different types of dispensing containers made of different materials; for clarity reason, the examples are given based on a lotion dispenser made of plastic materials, but an ordinary person in the art would know the variations to modify the design to make other types of dispensing bottles and containers functional and practically feasible.

The Get-Your-Money's-Worth container, alternatively called Enviro Bottle Jah, functions as 2 containers in 1. The larger sealed container transforms into a reusable smaller TSA Approval sized, resealable container to allow consumers to have access to the unreachable liquids that is stored at the bottom of the large container. There is a pre-cutline on the larger container that indicates where the smaller container starts. This pre-cut line is covered by a break seal. The break seal may be colored with a specific color to indicate the break line. The same top cover that is used for the large container will also be utilized to seal the smaller container by design. All the user has to do in order to get their moneys worth from the container when they can no longer extract fluid via the squeeze bottle function or the pump dispenser is to remove the pump if the container has one, remove the resealable cap, snap the container at the red seal pre-cut line. This will transform the large container into the small container and now consumer will have access to use the unreachable liquids at the bottom. User then can use the resealable cap to also seal the small container to preserve the amount that is left.

Figure 1A:
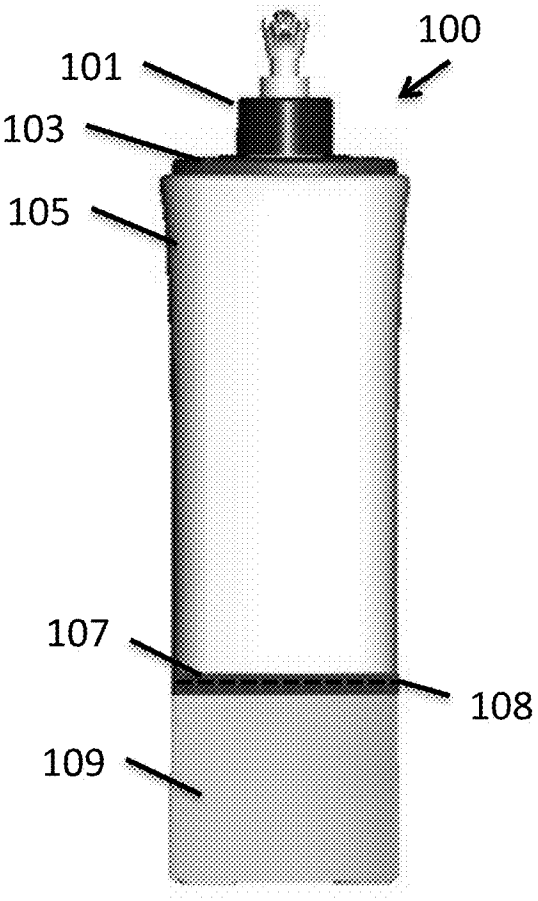
FIG. 1A is a front view of an example Get-Your-Money-Worth dispensing bottle in accordance with this application.

In reference to FIG. 1A and FIG. 1B, an example Get-Your-Money's-Worth container 100 includes a top mouth portion 101 for holding a dispensing pump or a dispensing tube, a cover portion 103 for sealing the mouth portion 101 to container upper body 105. Get-Your-Money's-Worth container 100 also includes a lower bottom portion 109 that is sized in TSA approved dimension (for example, holding about 100 ml liquid). A pre-cut but unbroken configuration 108 is set between the upper portion 105 and the bottom portion 109. To prevent premature breakage or leaking, the precut 108 is covered with a break seal mechanism 107, which can be designed as a pull open plastic ring integrally built-in to the container 100, similar to a pull-open envelope, or in alternative, the pre-cut line is seal covered with a heavy duty sealing tape. Break seal mechanism 107 may be colored with a distinct color to remind users the special design and usage of the Get-Your-Money's-Worth container. The diameter size and dimension of bottom portion 109 around the pre-cut line area 108 is configured to match and tightly fit cover portion 103, so that cover portion 103 can easily and tightly snap onto an opened bottom portion 109.

Figure 2B:
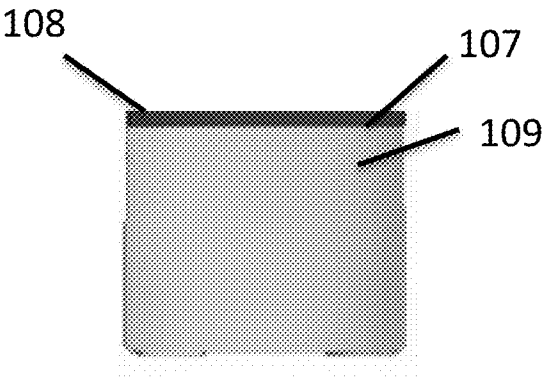
FIG. 2B is a front view of the lower portion of an example Get-Your-Money-Worth dispensing bottle in accordance with this application.
Figure 2A:
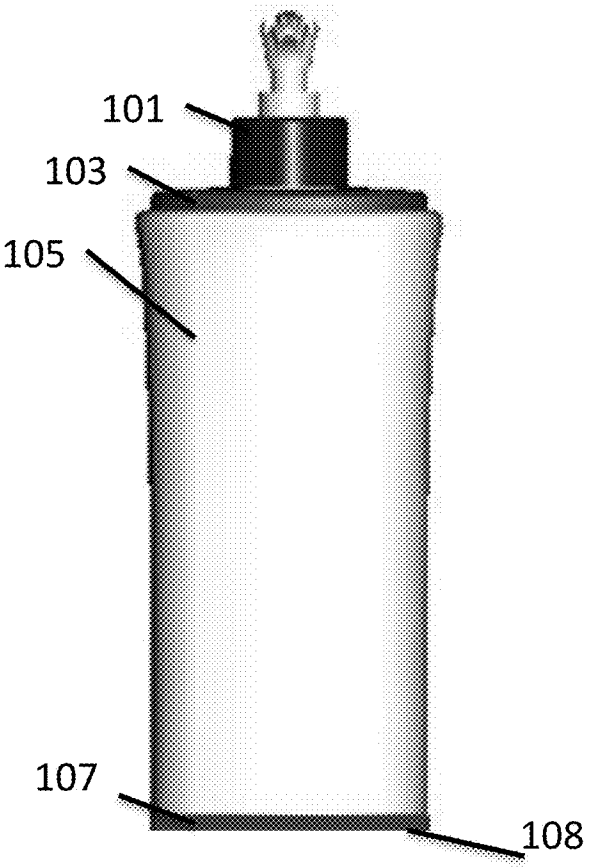
FIG. 2A is a front view of the upper portion of an example Get-Your-Money-Worth dispensing bottle in accordance with this application.

In reference to FIGS. 2A and 2B, a separated upper portion 105 and lower portion 109 are shown. By twisting the upper and lower portions of Get-Your-Money's-Worth container 100, or in the alternative, pulling open the break-seal mechanism 107 like a pull-open envelope, upper portion 105 and lower portion 109 are broken separate at the pre-cut line 108. The diameter size and dimension of bottom portion 109 around the pre-cut line area 108 is configured to match and tightly fit cover portion 103, so that cover portion 103 can easily and tightly snap onto an opened bottom portion 109.

Figure 3B:
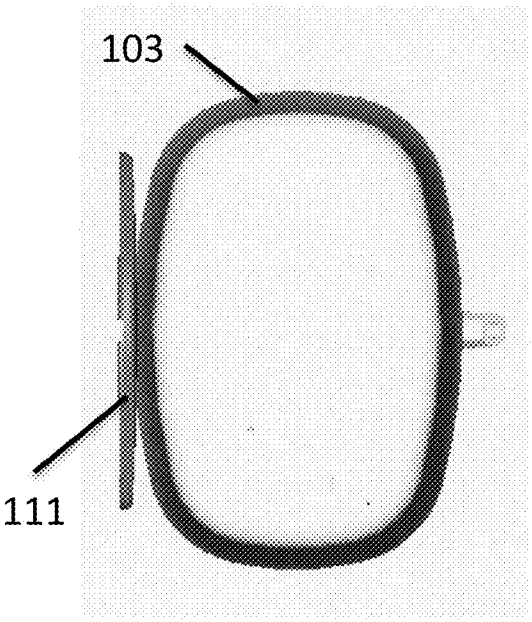
FIG. 3B is a sectional view of the upper portion of an example Get-Your-Money-Worth dispensing bottle in accordance with this application.
Figure 3A:
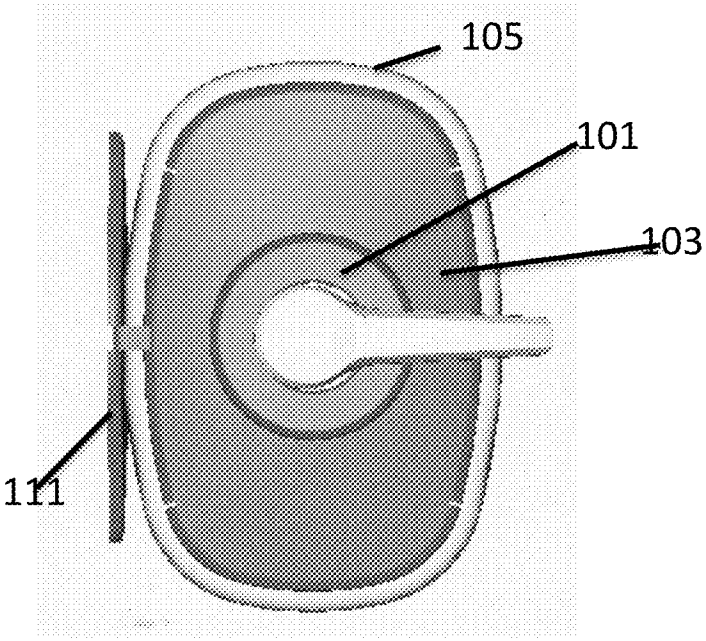
FIG. 3A is a top view of the upper portion of an example Get-Your-Money-Worth dispensing bottle in accordance with this application.

In reference to FIGS. 3A and 3B, an example top cover portion of Get-Your-Money's-Worth container 100 is shown. In this configuration, top cover 103 is configured with an aperture to hold pump nozzle 101. Top cover 103 in alternative can also configured with other shapes of aperture to hold other dispensing mechanism. Attached to cover 103 is a fliptop 111 with a configuration that matches the shape of the aperture so that it can seal the aperture of cover 103 and prevent contamination of content inside the container.

Figure 4B:
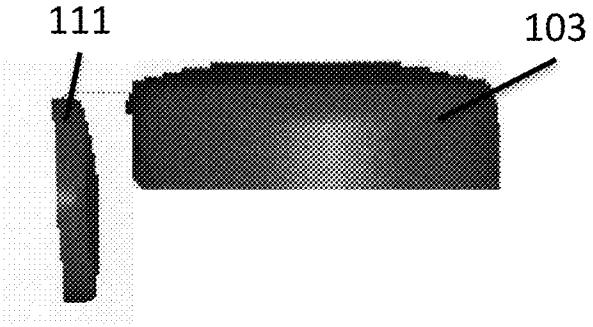
FIG. 4B is a side view of the top cover for the upper portion of an example Get-Your-Money-Worth dispensing bottle in accordance with this application.
Figure 4A:
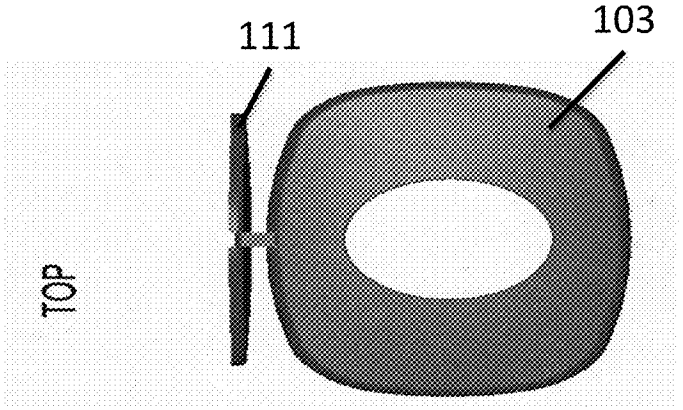
FIG. 4A is a top view of the top cover for the upper portion of an example Get-Your-Money-Worth dispensing bottle in accordance with this application.

In reference to FIGS. 4A and 4B, an example top cover 103 is shown where fliptop 111 is flexibly attached to cover 103, and cover 103 has a sufficient body length for napping and holding onto lower portion 109.

Figure 5:
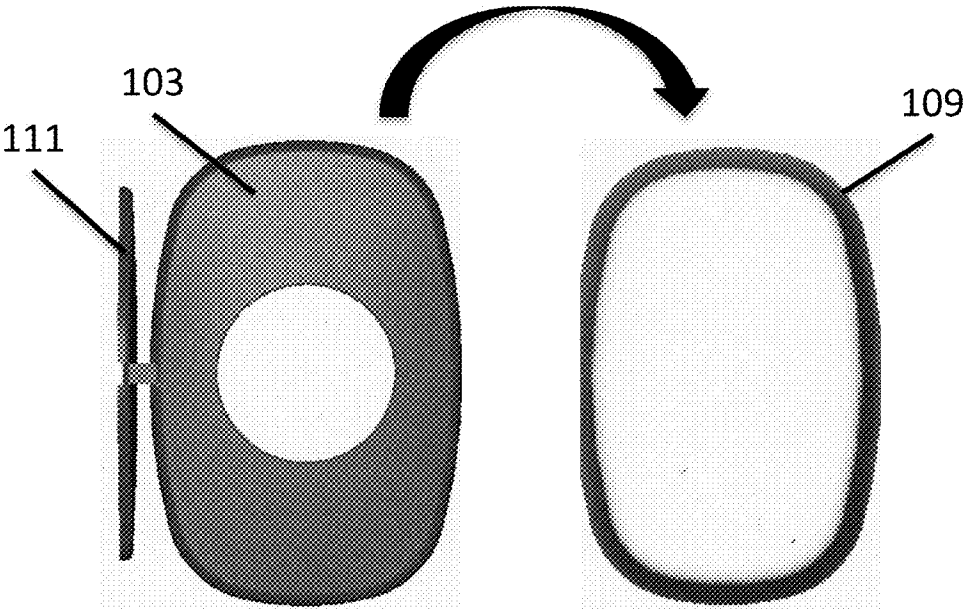
FIG. 5 shows an example snapping process of the top cover for the upper portion of FIG. 4A onto the lower portion in FIG. 2B of an example Get-Your-Money-Worth dispensing bottle in accordance with this application.

In reference to FIG. 5, a snapping process of cover 103 onto open-mouthed lower portion 109 is demonstrated. The diameter and dimension of cover 103 and the diameter and dimension of the opening area of lower bottle portion 109 are configured to match and fit so that they can easily and tightly snapped together.

Figure 6A:
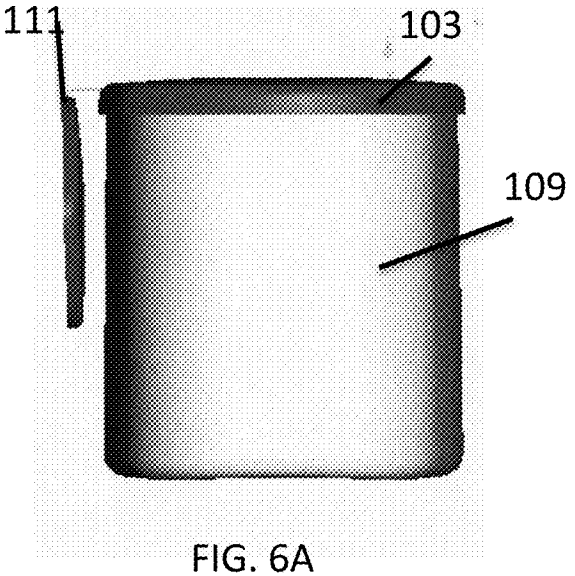
FIGS. 6A, 6B and 6C show an example snapping process of the fliptop of the top cover onto the aperture of the cover in FIG. 5 to covert the lower portion into a covered bottle in accordance with this application.
Figure 6B:
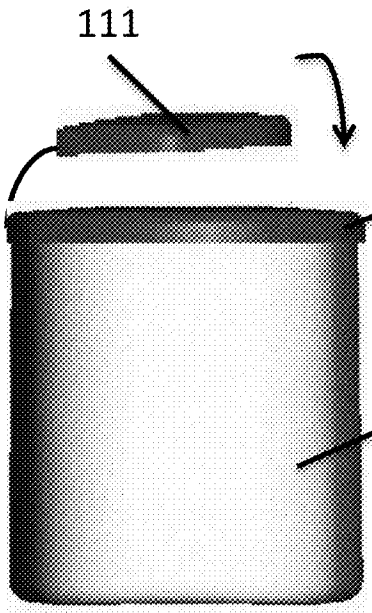
Figure 6C:
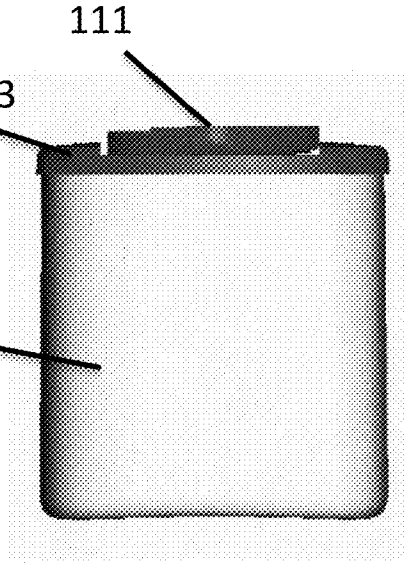

In reference to FIGS. 6A, 6B and 6C, a converting process of the lower bottle portion 109 into a covered bottle is demonstrated. When there are some left over lotion or liquid in bottle 100 that a user can't get to, what the user do is to remove the pump and throw it away, detach cover 103, and remove break seal tape 107, twist bottle 100 from left to right and snap cover 103 to lower portion 109 that contains the leftover lotion, and flip cover fliptop 111 over the aperture in cover 103. Lower portion 109 is then effectively converted into a reusable TSA approve sized jar. The left over lotion or liquid in the jar can be reached with fingers.

As will be recognized by those skilled in the art, the innovative concepts described in the present application can be modified and varied over a tremendous range of applications, and accordingly the scope of patented subject matter is not limited by any of the specific exemplary teachings given. It is intended to embrace all such alternatives, modifications and variations that fall within the spirit and broad scope of the appended claims.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A two-in-one dispensing bottle, comprising:

a cover;

an upper bottle body having a first opening and a second opening;

a lower bottle body having an opening and a sealed bottom;

a pre-cut unbroken section linking the second opening of said upper bottle body with the opening of said lower bottle body;

wherein said cover is configured to fit in size to both the first opening of the upper bottle body and the opening of the lower bottle body for snapping-on, and said pre-cut unbroken section is breakable with a twist.

2. The two-in-one dispensing bottle of claim 1, wherein said lower bottle body is of a Transportation Security Administration approved size and reusable.

3. The two-in-one dispensing bottle of claim 1, wherein said cover further comprises a fliptop that is flexibly attached to said cover and has a configuration to snap-seal an aperture in said cover.

4. The two-in-one dispensing bottle of claim 1, wherein said pre-cut unbroken section is covered with a break seal.

5. The two-in-one dispensing bottle of claim 4, wherein said break seal is of a distinct color.

6. The two-in-one dispensing bottle of claim 1, wherein said pre-cut unbroken section is marked with a distinct color.

7. A method for making money worth of a bottom content in a dispensing container, comprising the steps of actions comprising:

providing a two-in-one dispensing bottle, comprising:

a cover;

an upper bottle body having a first opening and a second opening;

a lower bottle body having an opening and a sealed bottom;

a pre-cut unbroken section linking the second opening of said upper bottle body with the opening of said lower bottle body;

wherein said cover is configured to fit in size to both the first opening of the upper bottle body and the opening of the lower bottle body for snapping-on, and said pre-cut unbroken section is breakable with a twist;

storing a liquid content inside said two-in-one dispensing bottle;

when said liquid content is at the lower bottle body, breaking the pre-cut unbroken section;

discarding the upper bottle body; and snapping on the cover to the opening of the lower bottle body.

8. The method of claim 7, wherein said lower bottle body is of a TSA approve size and reusable.

9. The method of claim 7, wherein said cover further comprises a fliptop that is flexibly attached to said cover and has a configuration to snap-seal an aperture in said cover.

10. The method of claim 7, wherein said pre-cut unbroken section is covered with a break seal.

11. The method of claim 10, wherein said break seal is of a distinct color.

12. The method of claim 7, wherein said pre-cut unbroken section is marked with a distinct color.

* * * * *